US005628572A

United States Patent [19]

Sato et al.

[11] Patent Number: 5,628,572

[45] Date of Patent: May 13, 1997

[54] PRINTER APPARATUS HAVING A VIBRATOR MOTOR

[75] Inventors: Katsuari Sato; Minoru Hoshino; Shinji Nureki; Shinichi Hayashizaki; Ko Yamazaki; Akihiro Iino, all of Tokyo, Japan

[73] Assignee: Seiko Instruments Inc., Japan

[21] Appl. No.: 239,605

[22] Filed: May 9, 1994

[30] Foreign Application Priority Data

May 11, 1993 [JP] Japan ..... 5-109611

[51] Int. Cl.[6] ..... B41J 19/00

[52] U.S. Cl. ..... 400/322; 400/323; 400/120.16

[58] Field of Search ..... 400/279, 319, 400/320, 322, 323, 120.16, 120.17; 310/323, 328; 347/37, 39, 197, 198

[56] References Cited

U.S. PATENT DOCUMENTS

| | | | |
|---|---|---|---|
| 4,580,150 | 4/1986 | Tazaki | 400/279 |
| 4,647,239 | 3/1987 | Maezawa et al. | 400/279 |
| 4,672,256 | 6/1987 | Okuno et al. | 310/323 |
| 4,832,518 | 5/1989 | Moriyama | 400/279 |
| 4,923,315 | 5/1990 | Yamaguchi et al. | 400/120.16 |
| 5,014,072 | 5/1991 | Yamaguchi et al. . | |
| 5,180,941 | 1/1993 | Seki et al. | 310/323 |

*Primary Examiner*—John S. Hilten
*Attorney, Agent, or Firm*—Adams & Wilks

[57] ABSTRACT

The present invention is directed to realize a portable, compact, light, thin, inexpensive and fast printer apparatus. A motor is provided between a printing head unit and a stationary frame member to drive the printing head unit relative to the stationary frame member in leftward and rightward directions, thereby eliminating conventional indirect driving components such as a stepping motor and a lead screw. Further, a sensor is provided in the printing head unit to detect a moving velocity and a position of the printing head unit to thereby construct the printer apparatus having reduced number of components to ensure stable driving and high accuracy. According to such a construction, the motor is integrated into the printing head unit, which self-moves in the printer apparatus to eliminate a mechanism converting a rotational movement into a linear movement, thereby achieving cost down of the printing apparatus.

21 Claims, 6 Drawing Sheets

PRINTER APPARATUS HAVING A VIBRATOR MOTOR

BACKGROUND OF THE INVENTION

The present invention relates to a printer apparatus, and particularly relates to a printer apparatus using an ultrasonic motor for driving a printing head unit.

Recently, down-sizing of electronic instruments has been required in the information processing field, hence the printer apparatus also needs to have a compact size, a light weight and a good portability as an output instrument. In this regard, research and development have been conducted to reduce the size and weight of components. However, down-sizing of existing components has been limited.

Conventionally, a compact printer apparatus uses one or plural stepping motors or else for driving a printing head carrier and feeding a record paper medium. Particularly, with regard to the driving of the printing head, generally a rotational movement of the motor is converted into a linear movement by means of a timing belt or a lead screw.

Namely, in the prior art, the stepping motor is utilized for driving the printing head so that various components, such as the timing belt and the lead screw, are indispensable, thereby increasing a number of components. Further, the size of the stepping motor is not reduced extremely because a given driving torque should be maintained. Therefore, it is quite difficult to effect further down-sizing by simply compacting the existing components.

BRIEF SUMMARY OF INVENTION

In order to solve the problems of the prior art, an object of the present invention is to provide a portable, compact and inexpensive printer apparatus having a light weight.

Another object of the present invention is to provide a printer apparatus having a thin shape.

A further object of the present invention is to provide a fast printer apparatus.

The foregoing objects and other objects as well as novel features are made apparent from the following description of the specification and the attached drawings.

In the printer apparatus according to the present invention, a motor is formed between a printing head unit and a stationary frame member, such that the printing head unit is driven by the motor in leftward and rightward directions relative to the stationary frame member, thereby eliminating a conventional stepping motor and indirect driving components such as a timing belt and a lead screw. Further, a sensor is provided in the printing head unit so as to detect a moving velocity and a position of the printing head unit to thereby construct a printer apparatus featuring stable driving and high accuracy with a small number of components.

According to the foregoing construction, the motor is formed between the printing head unit and the stationary frame member such that the printing head unit itself integrates the motor. Therefore, the printing head unit self-driven in the printer apparatus, thereby olviating the need for a mechanism for converting rotational movement into linear movement. By such a construction, a reduction in cost of the printer apparatus is achieved and a fast and accurate printer apparatus is realized. Further, down-sizing, reduction of weight and a thin shape are easily achieved for the printer apparatus.

DETAILED DESCRIPTION OF THE INVENTION

Figure 1:
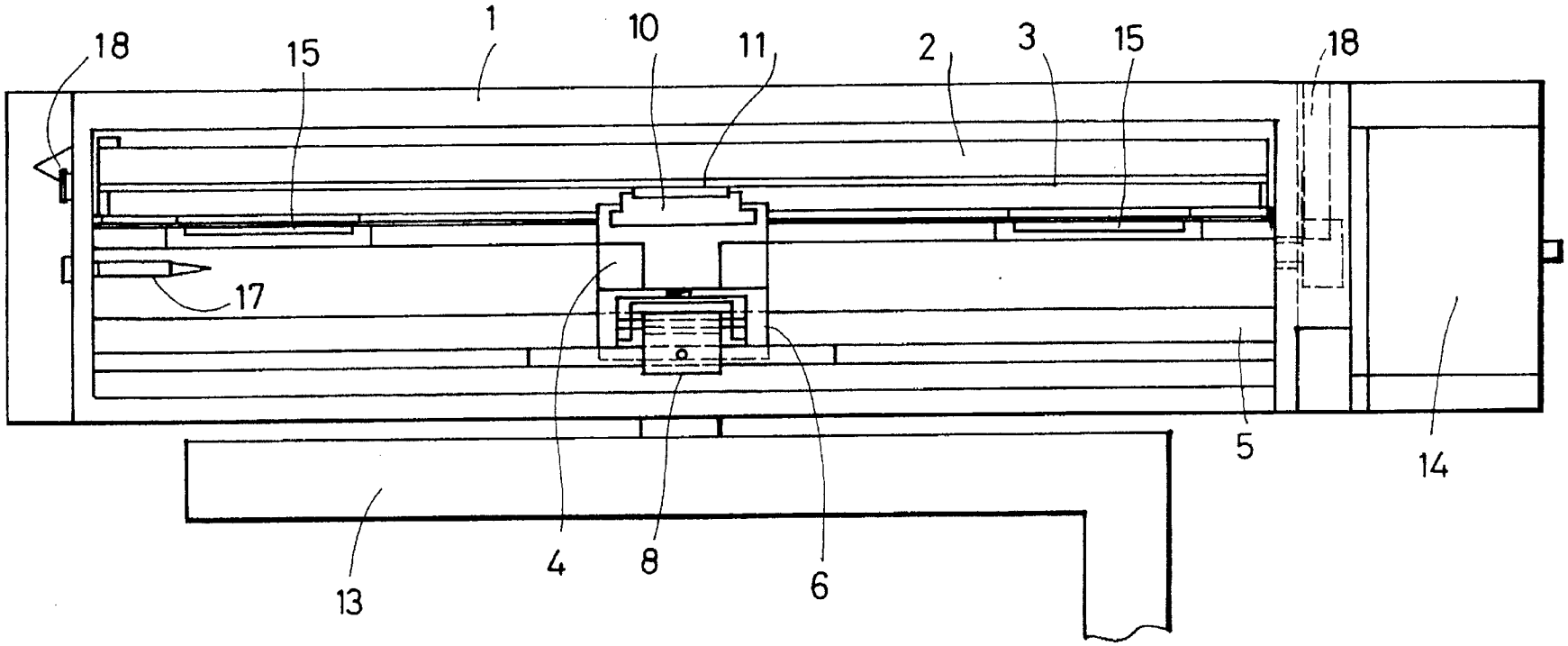
FIG. 1 is a plan view showing one embodiment of the present invention.

Hereinafter, an embodiment of the present invention will be described in detail with reference to the drawings. Throughout all the drawings, each part having the Same function is labeled by an identical reference numeral to avoid repeated description thereof.

Figure 2:
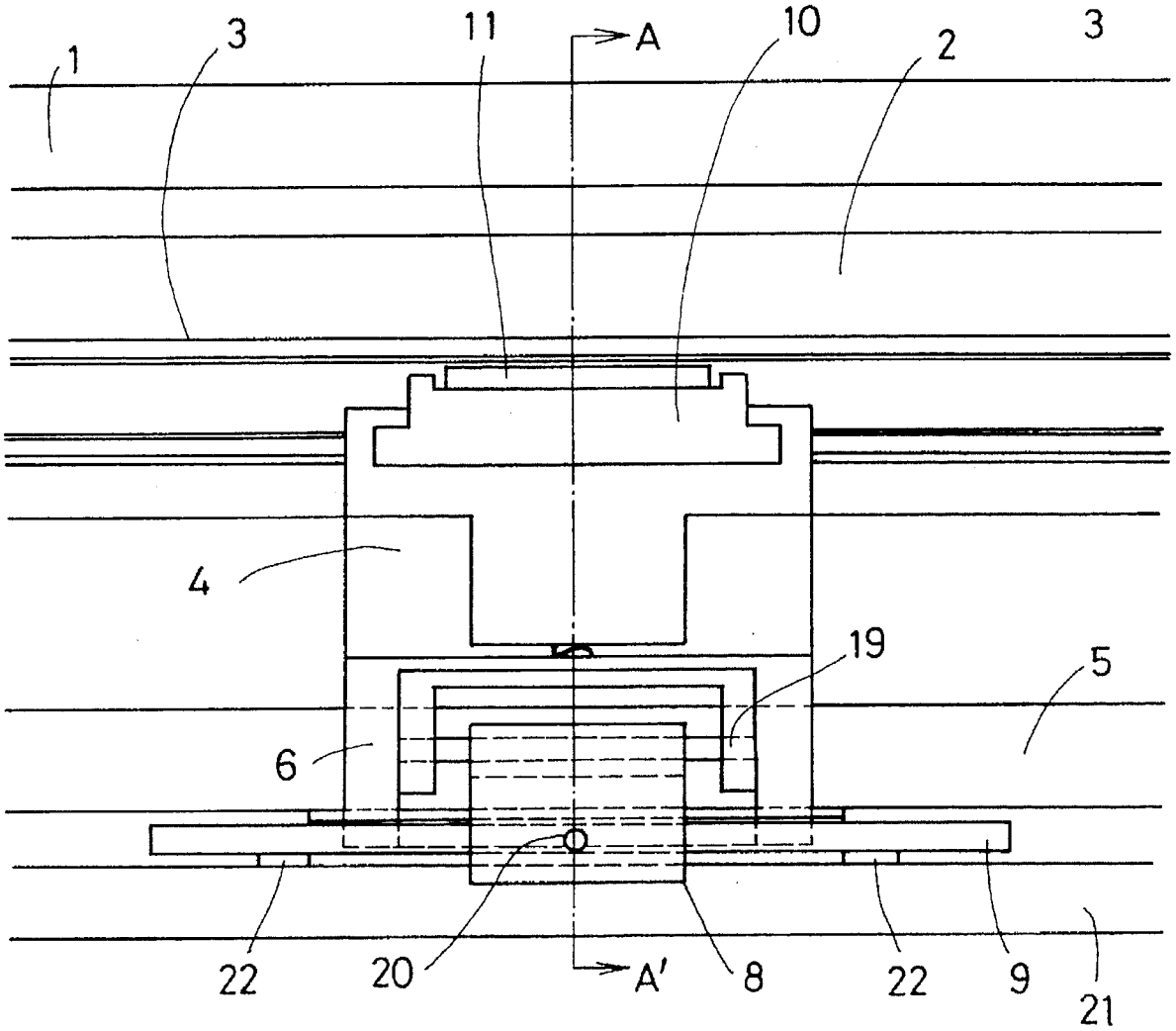
FIG. 2 is an enlarged partial plan view of FIG. 1.

FIG. 1 is a plan view showing one embodiment of the present invention, and FIG. 2 is an enlarged view of an essential part of FIG. 1. In FIGS. 1 and 2, a frame or base 1 supports various components of the printer apparatus. A platen body 2 is covered by a platen rubber 3. A head holder 4 has one part which supports a thermal head 11 through a heat sink 10, and another part formed with a guide hole 4*a* for receiving a guide shaft 5 as will be described later in detail.

A head carrier 6 has one part for pivotably supporting, through a motor holder 8, a vibrator 9 which generates a progressive wave by a piezoelectric oscillator 12, and another part formed with a guide hole 6*a* for receiving therethrough the guide shaft 5 as will be described later. The guide shaft 5 is attached to the frame 1 such as to pivotably support the head holder 4 and the head carrier 6 integrally with each other through the respective guide holes 4*a* and 6*a* to thereby guide these components slideably in the leftward and rightward directions in a reciprocal manner.

A motor guide member of a stationary frame member 21 is fixed to the base of the printer apparatus so as to form an ultrasonic motor between the member 21 and the vibrator 9 through a frictional member 22 provided on the vibrator 9. A platen spring 23 (FIG. 3) is disposed between the head holder 4 and the head carrier 6 which are supported pivotably by the guide shaft 5 such that the thermal head 11 disposed at one end of the head holder 4 is pressed onto the platen rubber 3, while the vibrator 9 disposed at one end of the head carrier 6 is pressed onto the motor guide member 21 so that the progressive wave of the vibrator 9 is efficiently transmitted to the motor guide member 21 to generate a drive torque from the ultrasonic motor.

On the other hand, the thermal head 11 having a plurality of thermal resistive elements operates according to an inputted print data for selectively activating the thermal resistive elements to develop characters or else on a record paper medium such as heat sensitive paper. The heat sink 10 supports the thermal head 11 as well as irradiates heat generated by the thermal head 11.

A flexible print substrate 13 composed of polyamide or else feeds electric signals to the vibrator 9 and the thermal head 11. A paper feeding motor 14 is provided to rotate a paper feeding roller 16 (shown in FIG. 3) through an idler gear and else (not shown in the figure). A paper guide 15 is provided to guide the record paper as well as to press the record paper to the paper feeding roller 16 to ensure stable paper feeding.

A head release pin 17 is provided such that, when the thermal head 11 is placed in an initial position outside a driving zone, the head holder 4 engages with the release pin 17 so that the thermal head 11 is removed away from the platen body 2, thereby facilitating a manual setting of the record paper, and a treating of the record paper during jamming. A platen pin 18 is disposed on each side of the frame 1 to pivotably support lengthwise opposite ends of the platen body 2 so as to enable the platen body 2 to stably and always contact the thermal head 11.

FIG. 2 is an enlarged plan view of the essential part of FIG. 1, and description of the components referred to in conjunction with FIG. 1 will be omitted. In FIG. 2, the motor holder 8 is pivotably supported by means of a pin 19 provided in the head holder 4, while the vibrator 9 is pivotably supported by means of another pin 20 provided in the motor holder 8, orthogonally to the pin 19. Accordingly, the vibrator 9 can be pivoted in either of X axis and Y axis relative to the head holder 4 so as to always closely contact the motor guide member 21.

The frictional member 22 is fixed to the vibrator 9 in opposed relation to the motor guide member 21 so as to transfer the progressive wave generated by the vibrator 9 to the motor guide member 21 to thereby frictionally slide relative to the motor guide member 21 to form the ultrasonic motor, and concurrently to reciprocally drive the printing head unit composed of the head holder 4 and the head carrier 6 along the motor guide member 21.

Figure 3:
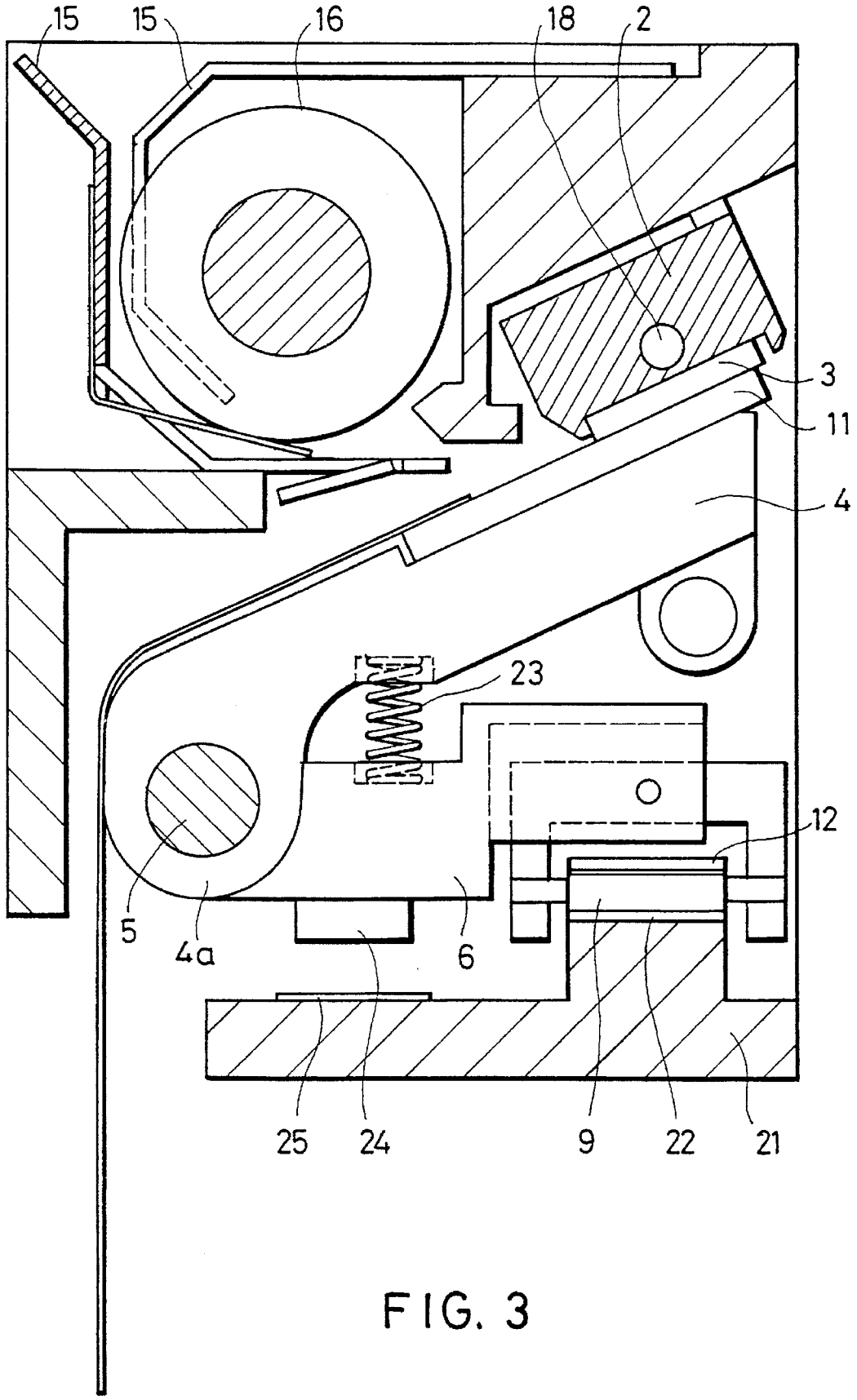
FIG. 3 is a sectional view taken along the line A–A' of FIG. 2.

FIG. 3 is a sectional diagram taken along the line A–A' of FIG. 2. In FIG. 3, the platen spring 23 is interposed between the head holder 4 and the head carrier 6 such that the thermal head 11 provided in the head holder 4 is pressed onto the thermally sensitive paper around a rotation center of the guide shaft 5, while the vibrator 9 provided in the head carrier 6 is urged onto the motor guide member 21 to constitute the ultrasonic motor of a driving means.

Further, a sensor 24 such as photosensor, magnetic sensor, laser sensor and encoder is disposed on a lower face of the head holder 4 in opposed relation to the motor guide member 21, while a sensor mark sheet 25 is disposed on a top face of the motor guide member 21 in opposed relation to the sensor 24.

Figure 4:
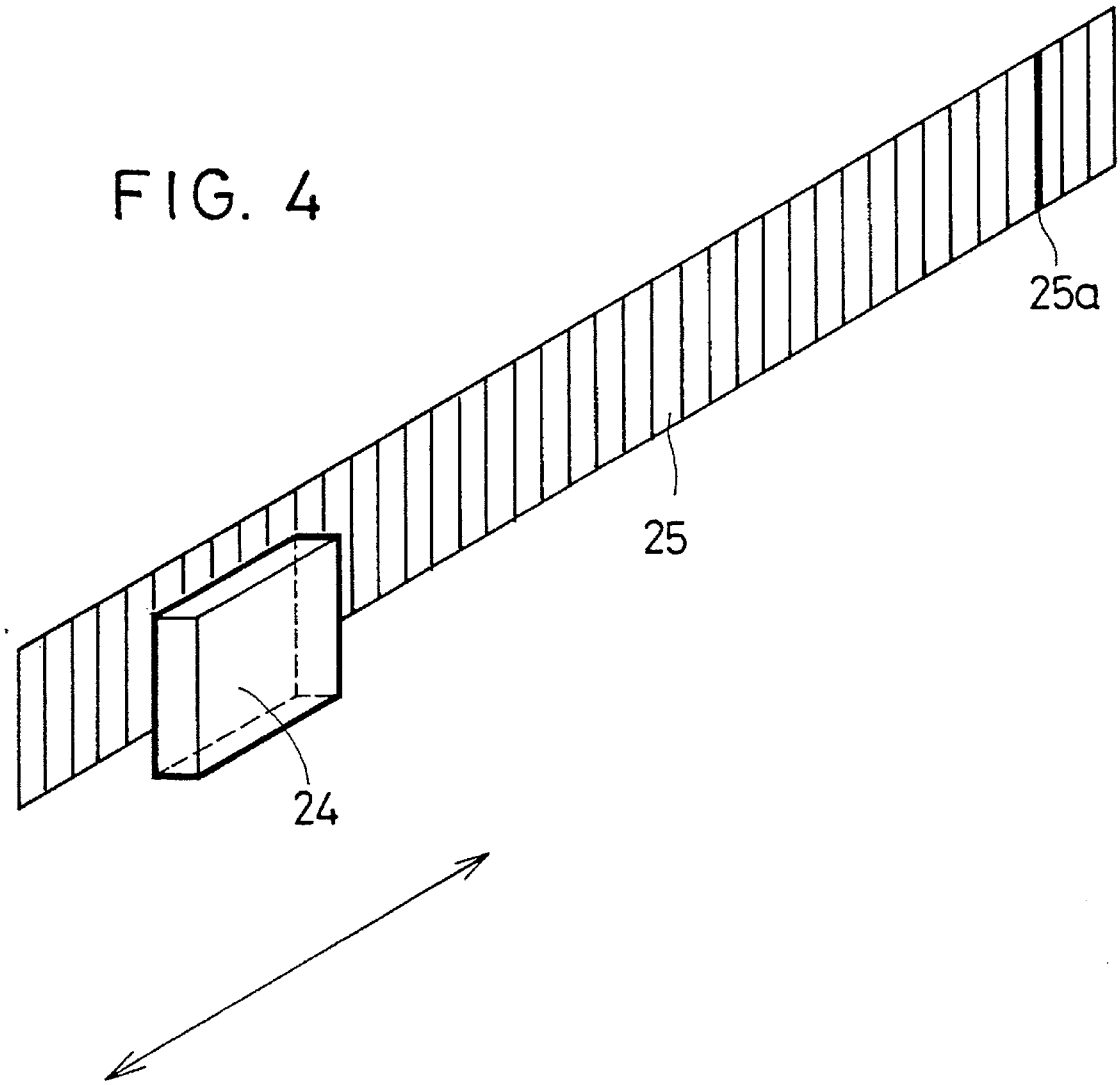
FIG. 4 is an illustrative diagram showing an operational principle of a sensor provided in the embodiment.

FIG. 4 is an illustrative diagram showing an operational principle of the sensor in the present embodiment. In FIG. 4, the sensor 24 operates to detect a moving position and a moving velocity of the thermal head 11. The sensor mark sheet 25 is recorded with a given bar code such as to reflect or absorb an infra-red ray emitted from the sensor 24 to enable detection of the moving position and the moving velocity according to a light receiving period of the reflected ray. Further, the sensor mark sheet 25 has at its particular area a home position indicating mark **25*a* which may have a width different from the remaining sections of the bar code, in order to detect, for example, a stop position at an end of the moving zone of the thermal head 11**.

Figure 5:
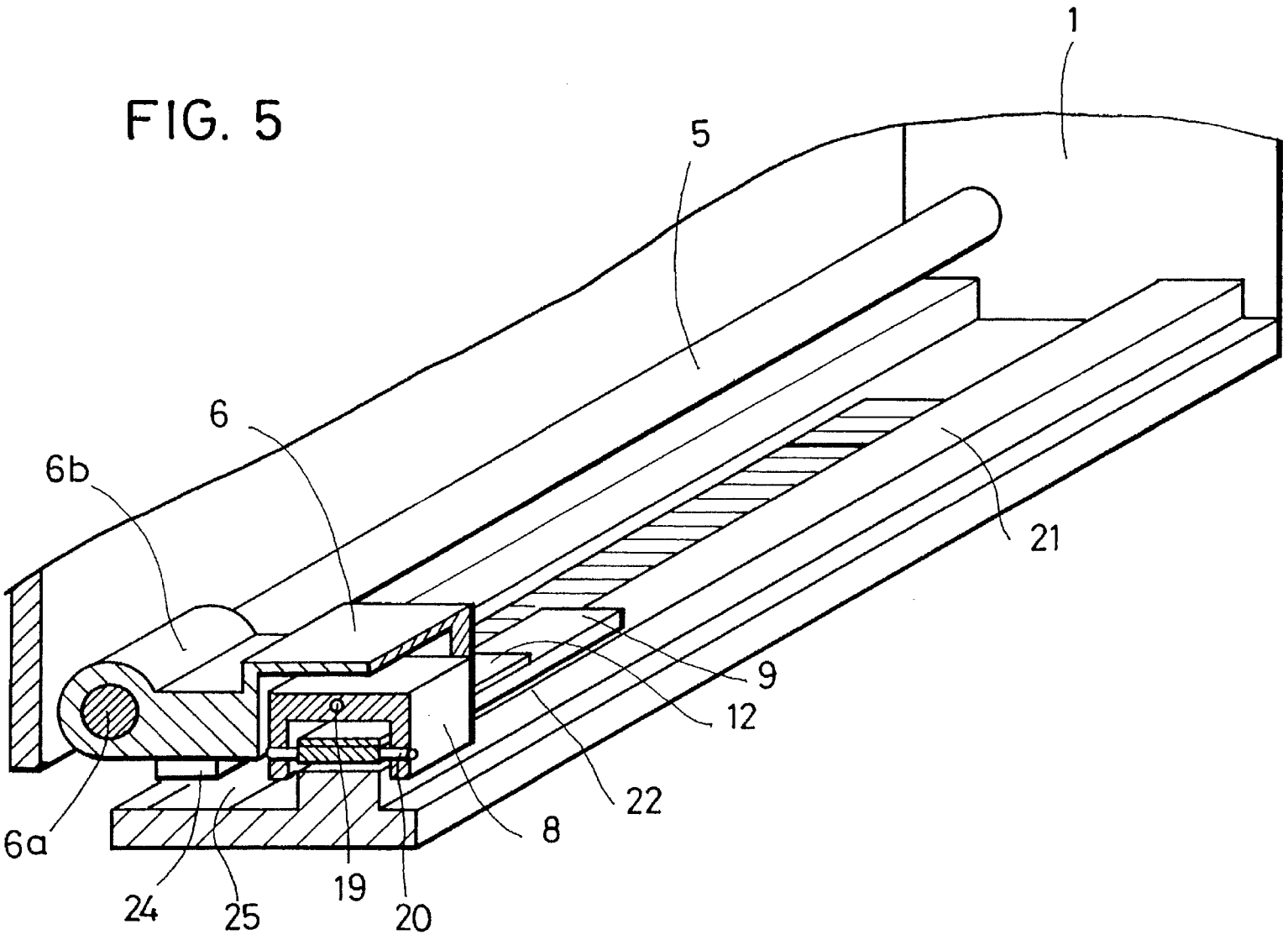
FIG. 5 is an enlarged perspective view of a structure of an ultrasonic motor provided in the embodiment.

FIG. 5 is a perspective enlarged view of a structure of the ultrasonic motor in the present embodiment. In FIG. 5, the head carrier 6 is inserted into the guide shaft 5 through the straight hole **6*b* formed at an end portion of the head carrier 6 together with the head holder 4 so that the head carrier 6 is rotatably supported around the guide shaft 5 while the head carrier 6 can displace reciprocally along a lengthwise direction of the guide shaft 5**.

Further, the vibrator 9 fixed with the piezoelectric element 12 is pivotably attached to another end of the head carrier 6 through the motor holder 8. The friction member 22 is adhered to the rear face of the vibrator 9. The head carrier 6 constitutes the ultrasonic motor together with the motor guide member 21 through the friction member 22. A voltage is applied to the piezoelectric element 12 so that the head carrier 6 reciprocally displaces along a surface of the motor guide member 21 together with the head holder.

Further, the head carrier 6 is provided with the sensor 24 which is opposed to the sensor mark sheet 25 disposed on the motor guide member 21.

Figure 6:
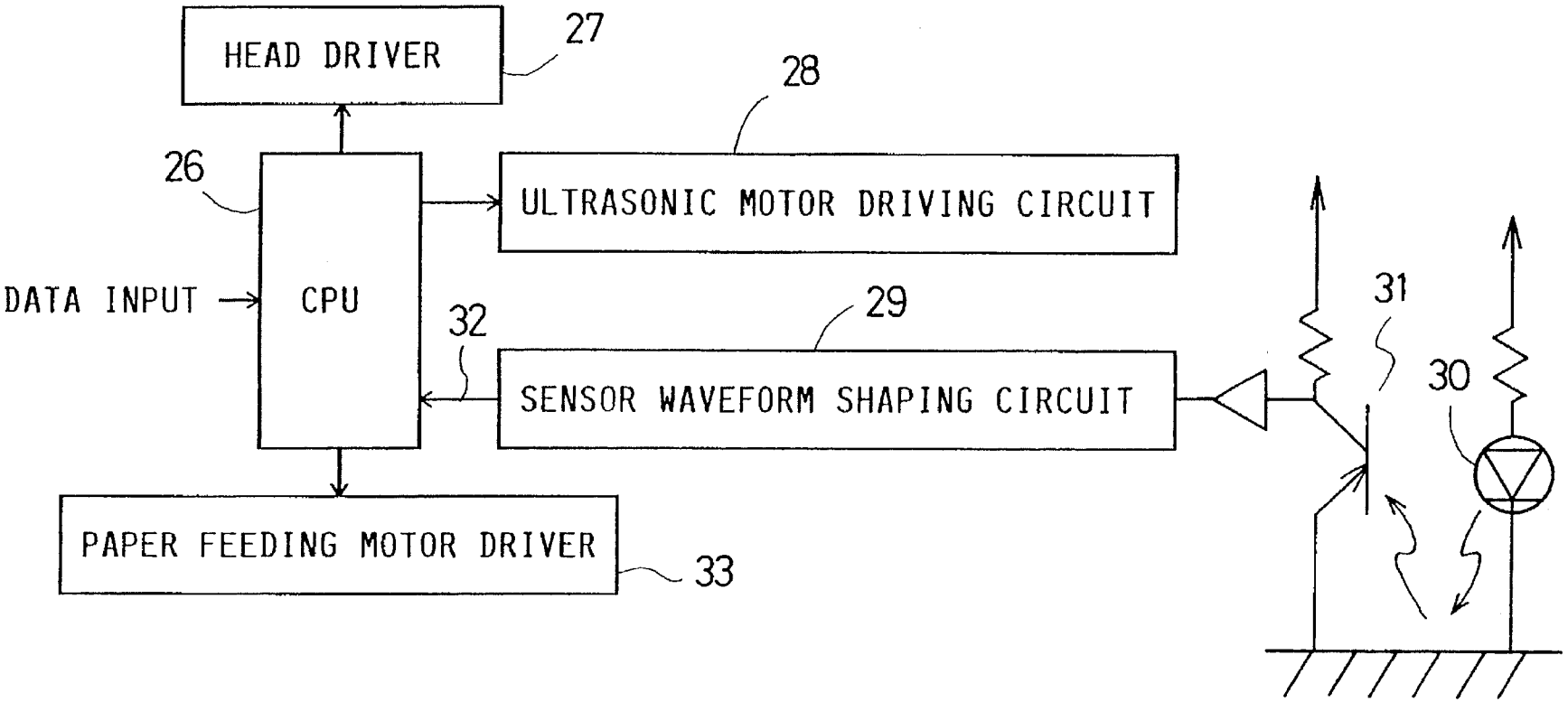
FIG. 6 is a block diagram schematically showing a circuit for driving the printer apparatus of the embodiment.

FIG. 6 is a block diagram schematically showing a driving circuit of the control means of the printer apparatus. In FIG. 6, a central processing unit (hereinafter, CPU) 26 receives a data inputted from a host (not shown in the figure) to control the printer apparatus. This circuit includes a head driver 27 for driving the thermal head 11 according to the inputted data, and an ultrasonic motor driving circuit 28 for applying a voltage to the piezoelectric element 12 to drive the vibrator 9.

The control means further including a sensor waveform shaping circuit 29 such that the reflected ray from a light emitting element 30 is received by a light receiving element 31, and thereafter the sensor waveform shaping circuit 29 carries out waveform shaping, a result of which is fed to an interruption terminal 32 of the CPU 26. The CPU 26 receives a signal from the interruption terminal 32 so as to detect the position and the moving velocity of the thermal head 11, thereby feeding signals to the head driver 27 and the ultrasonic motor driving circuit 28, respectively, to synchronize the head driver and the ultrasonic motor driving circuit to each other. Then, the head driver 27 outputs a print data in synchronization with the moving velocity of the thermal head 11. A paper feeding motor driver 33 operates when the photosensor 24 detects the home position for receiving a signal from the CPU 26 to carry out a paper feeding operation.

Next, the description is given for the operation of the present embodiment in conjunction with FIGS. 1–6.

(1) Paper feeding step

Under the state where the head holder 4 is inserted into the head release pin 17 at a leftmost position, the record paper is charged between the paper feeding roller 16 and the paper guide 15. By applying electric pulses to the paper feeding motor 14, the paper feeding motor 14 relates stepwise by a constant angle according to a number of the fed pulses.

The rotation of the paper feeding motor 14 is transmitted through a motor gear to a roller gear (not shown in the figures) to rotate the paper feeding roller 16. The record paper sandwiched between the paper feeding roller 16 and a biased portion of the paper guide 15 is fed toward the thermal head 11. When the record paper passes the thermal head 11, the application of the electric pulses to the paper feeding motor 14 is stopped so that the paper feeding motor 14 stops to hold the record paper to thereby finish the paper feeding step.

(2) Printing step

1 Forward stroke of printing

When an electric current flows through the ultrasonic motor formed between the head carrier 6 and the motor guide member 21, the printing head unit composed of the head carrier 6 and the head holder 4 starts to move in the rightward direction. At this time, a hole portion formed in a part of the head holder 4 of the printing head unit slidably displaces over an outer peripheral slanting portion of the head release pin 17. When the engagement between the head release pin 17 and the hope portion of the head holder 4 is broken, the thermal head 11 is pressed to the platen body 2 by means of the platen spring 23 to contact with the record paper disposed between the platen body 2 and the thermal head 11.

During this operation, the light emitting element 30 of the sensor 24 emits, for example, an infra-red ray to sequentially read the bar code printed on the sensor mark sheet 25 to thereby detect the moving velocity and the position of the thermal head 11 according to its reading timing.

When the printing head unit moves further, the CPU 26 feeds a selective print signal to the thermal head 11 through the head driver 27 to start the printing. At this time, the printing operation is carried out in synchronization with the moving state of the printing head unit.

When the sensor 24 detects the rightward home position after the thermal head 11 completes one line of the printing, the signal stops from the CPU to the ultrasonic motor driving circuit 28 to thereby hold the printing head unit.

2 Line shift

After the movement of the printing head unit is suspended, the CPU 26 feeds an electric pulse, corresponding to a given line shift amount, to the paper feeding motor 14 through the paper feeding motor driver 33. Consequently, the paper feeding motor 14 rotates correspondingly to the line shift amount to feed the record paper. The rotation of the paper feeding motor 14 is transmitted to the roller gear through the motor gear (not shown in the figures) to rotate the paper feeding roller 16 by a given rotation amount. Accordingly, the record paper sandwiched between the paper feeding roller 16 and the biased portion of the paper guide 15 is fed by one line to finish the line shift.

3 Returning stroke of printing

When the electric current flows through the ultrasonic motor in a reverse direction, the printing head unit starts to move in a direction opposite to the forward direction. When the thermal head 11 reaches the predetermined printing zone after the printing head unit displaces a given distance, the printing operation is commenced in manner similar to the previous printing operation. When the thermal head 11 completes one line of the printing, the application of the electric current to the ultrasonic motor is stopped so that the printing head unit returns to the leftward home position. Thereafter, the similar printing operation is repeatedly carried out to finish the printing.

The invention is described in detail based on the disclosed embodiment; however, the invention is not limited to the disclosed embodiment, but may cover various modifications within the scope of the essential concept.

As described above, according to the invention, the ultrasonic motor is integrated into the printing head unit to self-drive the printing head unit, thereby eliminating a conventional conversion mechanism which converts the rotational movement of the stepping motor into the horizontal linear movement. Further, construction of the printer apparatus is simplified, and a compact, light, thin, fast, accurate and inexpensive printer apparatus is obtained.

What is claimed is:

1. A printer apparatus comprising: a base; a guide shaft mounted on the base; a platen body disposed on the base; printing means having a printing head unit for printing on a paper medium, the printing head unit having a head holder having a first end supporting a thermal head and a second end slidably supported by the guide shaft, and a head carrier slidably supported by the guide shaft for carrying the printing head unit; position detecting means for detecting a moving position of the printing head unit; paper feeding means for feeding the paper medium in synchronization with a printing timing of the printing head unit; control means for controlling the printing means and the paper feeding means; a vibrator disposed in the head carrier for generating a progressive wave, the carrier having a first end supporting a motor holder supporting the vibrator and a second end slidably supported by the guide shaft; a motor guide member provided on the base in opposed relation to the vibrator such that the motor guide member and the vibrator integrally constitute a motor to drive the head carrier; first means for pivotally supporting the motor holder to the head carrier; and second means for pivotally supporting the vibrator to the motor holder.

2. A printer apparatus according to claim 1; wherein the first means comprises a first pin provided in the head holder, and the second means comprises a second pin provided in the motor holder.

3. A printer apparatus according to claim 2; wherein the first pin and the second pin extend along mutually orthogonal axes.

4. A printer apparatus comprising: a base; a guide shaft mounted on the base; a platen body disposed on the base; printing means having a printing head unit for printing on a paper medium, the printing head unit having a head holder having a first end supporting a thermal head and a second end slidably supported by the guide shaft, and a head carrier slidably supported by the guide shaft for carrying the printing head unit; the first end of the head carrier and the first end of the head holder being pivotally supported by the guide shaft; position detecting means for detecting a moving position of the printing head unit; paper feeding means for feeding the paper medium in synchronization with a printing timing of the printing head unit; control means for controlling the printing means and the paper feeding means; a vibrator disposed in the head carrier for generating a progressive wave, the carrier having a first end supporting a motor holder supporting the vibrator and a second end slidably supported by the guide shaft; and a motor guide member provided on the base in opposed relation to the vibrator such that the motor guide member and the vibrator integrally constitute a motor to drive the head carrier.

5. A printer apparatus comprising: a base; a guide shaft mounted on the base; a platen body disposed on the base; a printing head unit having a printer head for printing on a paper medium, a head holder slidably supported by the guide shaft for supporting the printer head, and a head carrier slidably supported by the guide shaft for carrying the printing head unit; a motor holder; first means for pivotally supporting the motor holder to the head carrier; driving means including a vibrator for generating a progressive wave to self-drive the head carrier along the guide shaft; second means for pivotally supporting the vibrator to the motor holder; and control means for controlling the driving means.

6. A printer apparatus according to claim 5; further comprising a motor guide member provided on the base in opposed relation to the vibrator such that the motor guide member and the vibrator integrally constitute an ultrasonic motor to drive the head carrier.

7. A printer apparatus according to claim 6; further comprising a frictional member disposed over the vibrator in opposed relation to the motor guide member to transfer the progressive wave generated by the vibrator to the motor guide member to reciprocally drive the printing head unit along the motor guide member.

8. A printer apparatus according to claim 5; wherein the first means comprises a first pin provided on the head holder, and the second means comprises a second pin provided on the motor holder.

9. A printer apparatus according to claim 8; wherein the first pin and the second pin extend along mutually orthogonal axes.

10. A printer apparatus according to claim 5; further comprising a biasing member disposed between the head holder and the head carrier to urge the printing head into contact with the platen body and the vibrator into contact with the motor guide member.

11. A printer apparatus comprising; a base; a guide shaft mounted on the base; a platen body disposed on the base; a printing head unit having a head carrier slidably supported by the guide shaft for carrying the printing head unit, and a head holder having a first end supporting a thermal head and a second end slidably supported by the guide shaft; an ultrasonic motor integral with the printing head unit for self-driving the head carrier along the guide shaft, the ultrasonic motor having a vibrator connected to the head carrier for generating a progressive wave and a motor guide member provided on the base in opposed relation to the vibrator; a motor holder supported by the head carrier and supporting the vibrator; control means for controlling the ultrasonic motor; and a biasing member disposed between the head holder and the head carrier to urge the thermal head into contact with the platen body and the vibrator into contact with the motor guide member.

12. A printer apparatus comprising: a base; a guide shaft mounted on the base; a platen body disposed on the base; a printing head unit having a printer head for printing on a paper medium, a head holder slidably supported by the guide shaft for supporting the printer head, and a head carrier slidably supported by the guide shaft for carrying the printing head unit; a vibrator disposed on the head carrier for generating a progressive wave; a motor guide member provided on the base in opposed relation to the vibrator such that the motor guide member and the vibrator integrally constitute an ultrasonic motor to drive the head carrier; and biasing means disposed between the head holder and the head carrier for urging the printer head into contact with the platen body and urging the vibrator into contact with the motor guide member.

13. A printer apparatus according to claim 12; further comprising a frictional member disposed over the vibrator in opposed relation to the motor guide member to transfer the progressive wave generated by the vibrator to the motor guide member to reciprocally drive the printing head unit along the motor guide member.

14. A printer apparatus according to claim 12; further comprising position detecting means for detecting a moving position of the printing head unit.

15. A printer apparatus according to claim 14; wherein the position detecting means comprises a sensor attached to the printing head unit and being selected from a group consisting of a photosensor, an encoder, a magnetic sensor and a laser sensor, and a mark sheet disposed on the motor guide member for detecting a moving velocity of the printing head unit in addition to the moving position thereof.

16. A printer apparatus according to claim 15; wherein the sensor is disposed on a lower surface of the head holder in opposed relation to the motor guide member, and the mark sheet is disposed on a top surface of the motor guide member in opposed relation to the sensor.

17. A printer apparatus according to claim 12; wherein the head carrier comprises a first end supporting a motor holder supporting the vibrator, and a second end slidably supported by the guide shaft.

18. A printer apparatus according to claim 17; further comprising first means for pivotally supporting the motor holder to the head carrier, and second means for pivotally supporting the vibrator to the motor holder.

19. A printer apparatus according to claim 18; wherein the first means comprises a first pin provided on the head holder, and the second means comprises a second pin provided on the motor holder.

20. A printer apparatus according to claim 19; wherein the first pin and the second pin extend along mutually orthogonal axes.

21. A printer apparatus according to claim 17; wherein the first end of the head carrier and a first end of the head holder are pivotally supported by the guide shaft.

* * * * *